United States Patent [19]

Alperson

[11] Patent Number: 4,911,393

[45] Date of Patent: Mar. 27, 1990

[54] RETAILING DISPLAY BRACKET

[76] Inventor: Joel H. Alperson, 10320 J St., Omaha, Nebr. 68127

[21] Appl. No.: 333,259

[22] Filed: Apr. 5, 1989

[51] Int. Cl.[4] ..... A47F 1/00

[52] U.S. Cl. ..... 248/297.2; 248/246

[58] Field of Search ..... 248/297.2, 246, 245, 248/244, 297.3, 217.1

[56] References Cited

U.S. PATENT DOCUMENTS

| | | | |
|---|---|---|---|
| 200,773 | 2/1878 | Smith | 248/244 |
| 811,254 | 1/1906 | Smith | 248/217.1 X |
| 1,098,945 | 6/1914 | Frederick | 248/217.1 X |
| 2,737,268 | 3/1956 | Smith | 248/245 X |
| 3,203,375 | 8/1965 | Schroeder | 248/246 X |
| 3,834,659 | 9/1974 | Siegal | 248/245 |
| 4,170,335 | 10/1974 | King | 248/297.2 X |
| 4,508,363 | 4/1985 | Temple | 297/483 X |

FOREIGN PATENT DOCUMENTS

| | | | |
|---|---|---|---|
| 6410236 | 3/1965 | Netherlands | 248/244 |
| 662713 | 12/1951 | United Kingdom | 248/217.1 |
| 1560724 | 2/1980 | United Kingdom | 248/246 |

*Primary Examiner*—Alvin C. Chin-Shue

*Attorney, Agent, or Firm*—George R. Nimmer

[57] ABSTRACT

For cantilever mounting to and slidable positioning along upright channel members, there is disclosed retailing display brackets including a conventional display or hanger bar that is connected to a novel anchor-member. The anchor-member has triangular wings including a rearward prong and also leaf-spring which together normally bear against the channel rear-face and effect a cantilever mounting for the elongate bar. With such prongs and leaf-spring combination, specially contoured or perforate channel rear-faces are unnecessary. For slideable height adjustment of the anchor-member along the upright channel, the operator briefly maintains the elongate bar in an inclined condition which de-activates the wing prong and the leaf-spring during the height adjustment process.

3 Claims, 1 Drawing Sheet

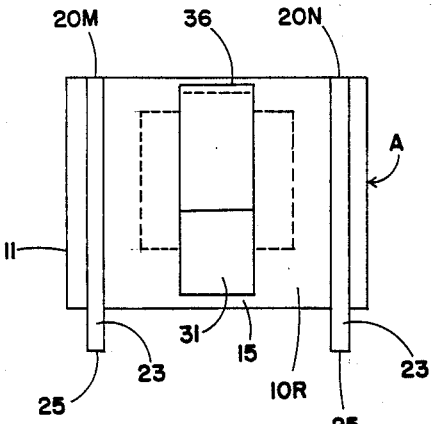
FIG. 1
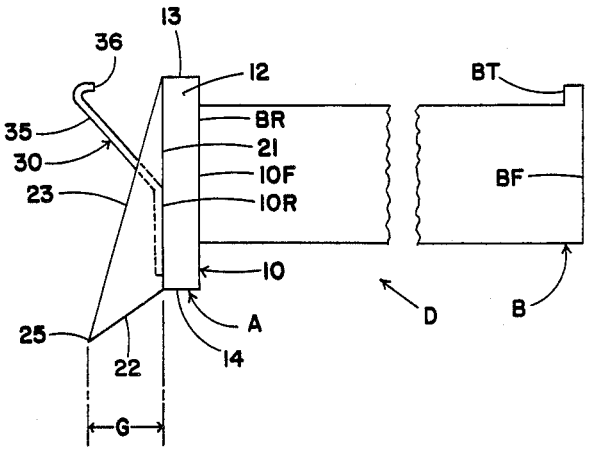
FIG. 2
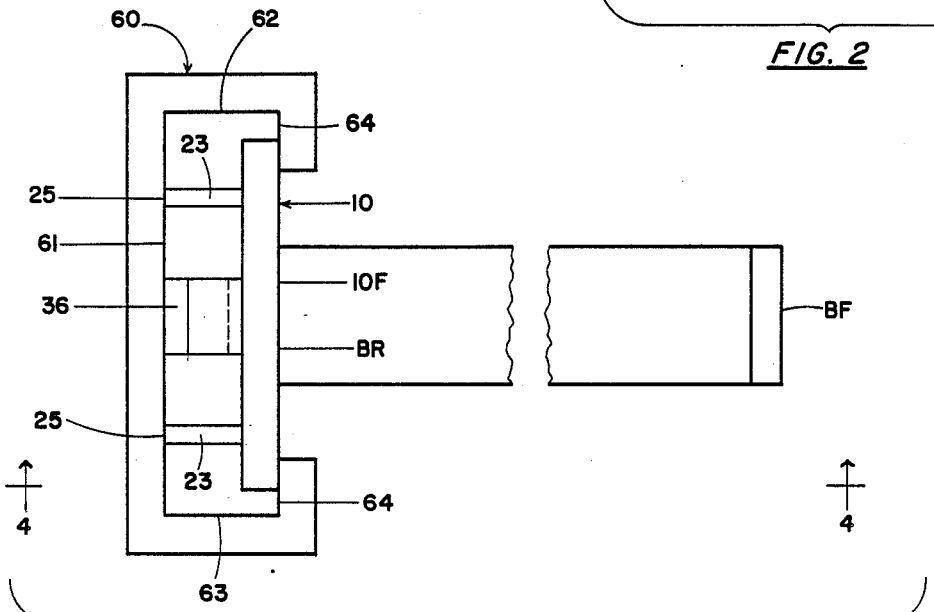
FIG. 3
FIG. 4
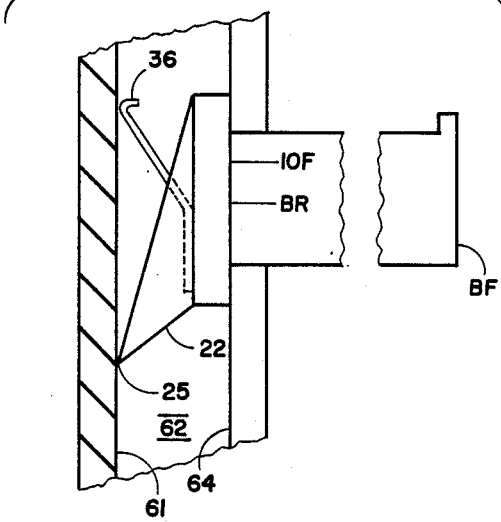
FIG. 4A
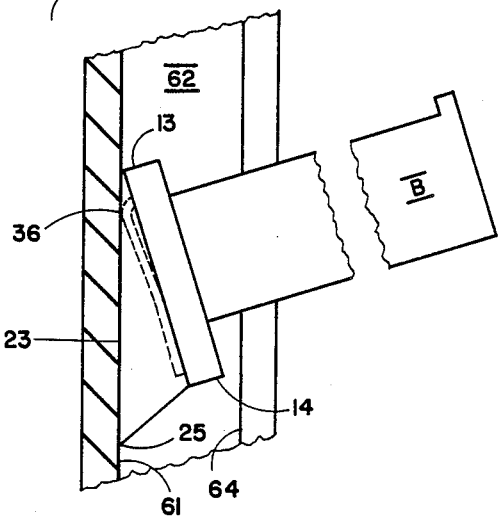

RETAILING DISPLAY BRACKET

BACKGROUND OF THE INVENTION

Retailing show rooms typically include vertical channel members having one or more retailing display brackets mounted thereto in cantilever fashion. The bracket employs an elongate display or anchor bar that is connected to an anchor-member which is engaged with the channel member. Because retailers periodically desire to change the bracket bar elevation, they've had to employ relatively expensive channel members, such as those altered at vertical intervals with dimples or performations. Not only are such channels expensive, they do not permit bracket height adjustment to levels between neighboring dimples or perforations.

OBJECT OF THE INVENTION

It is the general objective of the present invention to provide retailing display brackets that can be reliably mounted in cantilever fashion with upright channel members devoid of expensive dimpling or perforations but which can be conveniently slidably re-positioned along and thence self-locking at any desired elevation of the rudimentary upright channel member.

GENERAL STATEMENT OF THE INVENTION

With the aforestated general objective in view, and together with ancillary and specific objectives which will become more apparent as this description proceeds, the retailing display bracket of the present invention utilizes a conventional display or hanger bar which is rearwardly attached to the upright web portion of an anchor-member that is slidably and thence self-lockably disposed within a rudimentary upright channel member, the anchor-member also including preferably two triangular wings attached to the web portion and extending rearwardly therefrom as an apexial prong capable of tenaciously impinging against the channel member rear-face, and the anchor-member further including at least one leaf-spring for resiliently bearing against the channel rear-face but which is readily de-actuatable along with the apexial prongs whenever the anchor-member is to be slidably adjustably moved along the upright channel member.

BRIEF DESCRIPTION OF THE DRAWING

In the drawing, wherein like characters refer to like parts in the several views, and in which:

FIG. 1 is a rearward elevational view of a representative embodiment (D) of the retailing display bracket of the present invention;

FIG. 2 is a right side elevational view of said FIG. 1 embodiment (D);

FIG. 3 is a top plan view of embodiment D but shown in a self-locking mode with an upright channel environment;

FIG. 4 is a sectional elevational view taken along line 4—4 of FIG. 3; and FIG. 4A is a sectional elevational view similar to FIG. 4 but wherein the bracket is in a slidably adjustable mode along the upright channel environment.

DETAILED DESCRIPTION OF THE DRAWING

Representative embodiment D of the retailing display bracket comprises a conventional elongate bar B extending rigidly forwardly from the upright web portion (10) of a novel anchor-member A.

Elongate bar, conventionally employed in retail display (such as hanging garments therefrom, etc.) includes transversely extending ends (BF, BR) and sometimes an upstanding lip BT at bar front-end BF.

Anchor-member A comprises three main components: a web member (e.g. 10); at least one, and preferably at least two, transversely separated traingular wings (e.g. 20M, 20N); and leaf-spring means (e.g. 30).

Upright web member embodiment 10 is of rectangular plate configuration and includes: upright side-edges 11 and 12; horizontally and transversely extending top-edge 13 and bottom-edge 14; and upright front-surface 10F and upright rear-surface 10R. 15 denotes a central lower area of web rear-surface 10R. Bar rear-end BR is attached, as by soldering, welding, etc., to web front-surface 10F.

Parallel, upright wings 20 are preferably of obtusely triangular shape wherein: 21 denotes the frontleg; 22 denotes the shortest leg; 23 denotes the lengthiest leg; and 25 denotes an angular prong provided by the intersection of legs 22 and 23. Herein, the geometrically and dimensionally identical wings 20M and 20N, at their firstlegs 21, are rigidly attached to transversely separated locations of web 10. Accordingly, web lengthiest leg 23 is located rearwardly of web rear-surface 10R and acute-angle prong 25 is located a finite-gap G rearwardly of rear-surface 10R. Such angular prongs (25) are preferably disposed in elevation below web central lower portion 15.

Upright leaf-spring 30 includes a lower-length 31 attached, as by soldering, etc., to web central lower portion 15. Extending upwardly and rearwardly of attached lower-length 31 is leaf-spring upper-length 35 that has its rearward extremity (36) spaced more than said finite-gap G from web member 10.

Turning now to drawing FIGS. 3, 4, and 4A, which depict the FIGS. 1 and 2 embodiment D in an upright channel environment e.g. metallic channel 60. Characters 61–64 indicate upright, and permissibly wholly planar, upright faces at the channel interior including: rear-face 61, side-faces 62–63, and transversely interrupted front-faces 64.

A slidably moveable or height adjustment mode for bracket D along channel interior 61–64 is alluded to in FIG. 4A, and wherein the operator necessarily maintains bar B so that it extends forwardly/upwardly from channel faces 61 and 64. In such forward/upward inclination for bar B, slidability of bracket D along the channel interior is possible because:

wing lengthiest leg 23 is substantially parallel to (and desireably abuts) rear-face 61, and leaf-spring upper-length 35 is compressed between rear-face 61 and web rear-surface 10R, whereby angular prongs 25 are not confronting rear-face 61.

However, when the operator releases bar B, the bar weight and augmented by leaf-spring pressure (35) at channel rear-face 61, causes bar B to assume the generally horizontal configuration alluded to in FIG. 4. When this occurs, web front-surface 10F abuts channel front-faces 64 and preferably metallic prongs 25 tenaciously frictionally bear against channel rear-face 61. The said abutment for web 10 and the said frictional tenacity for prongs 25 afford a self-locking mode for anchor-member A at said previously slidably selected channel height elevation.

Thereafter, whenever the operator desires to change the bracket height along the channel, he/she again manipulates bar B according to the procedure previously described with reference to FIG. 4A.

From the foregoing, the construction and operation of the retailing display bracket will be readily understood and further explanation is believed to be unnecessary. However, since numerous modifications changes will readily occur to those skilled in the art, it is not desired to limit the invention to the exact construction shown and described, and accordingly, all suitable modifications and changes may be resorted to, falling within the scope of the appended claims.

I claim:

1. For use in slidably moveable and thence self-locking combination along the interior of an upright channel member, retailing display bracket comprising:

(A) a generally horizontally extending bar having a transversely extending rear-end and a front-end; and (B) an anchor-member including:

(i) a web member having transversely extending rear-surface and front-surface, said bar rear-end being attached to said web member at the front-surface thereof;

(ii) a pair of substantially parallel wings attached to transversely separated locations of said web member, each wing being of substantially identical obtusely triangular shape and wherein: the lengthiest leg extends linearly downwardly and rearwardly from an upper portion of the web member, and the shortest leg extends linearly downwardly and rearwardly from a lower portion of the web member to provide an acute-angle prong at the intersection of said lengthiest and shortest legs, whereby said prong is located below and also at a finite-gap rearwardly of said web member; and (iii) attached to a central lower portion of said web member and extending upwardly and rearwardly from the rear-surface thereof, a leaf-spring having a rearward-extremity spaced more than said finite-gap from said web member.

2. The retailing display bracket of claim 1 wherein the two wings are geometrically identical; and wherein the wing has a frontleg attached to said web member, said frontleg being the second-lengthiest leg for said triangular wing.

3. The retailing display bracket of claim 2 wherein the bar extends substantially perpendicularly rigidly forwardly from the web member.

* * * * *